US006575345B2

(12) United States Patent
Pitzen et al.

(10) Patent No.: US 6,575,345 B2
(45) Date of Patent: Jun. 10, 2003

(54) ROLLED SHEET MATERIAL DISPENSER WITH SAFER SHEET CUTTING MEANS

(75) Inventors: James F. Pitzen, Maplewood, MN (US); Ronald C. Johansson, Stillwater, MN (US); Mark D. Sorlien, White Bear Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 4 days.

(21) Appl. No.: 09/745,586

(22) Filed: Dec. 21, 2000

(65) Prior Publication Data

US 2002/0079344 A1 Jun. 27, 2002

(51) Int. Cl.[7] ..... B26F 3/02
(52) U.S. Cl. ..... 225/19; 225/89
(58) Field of Search ..... 225/19, 20, 61, 225/66, 86, 89, 22

(56) References Cited

U.S. PATENT DOCUMENTS

| | | | | |
|---|---|---|---|---|
| 2,203,073 A | * | 6/1940 | Anderson | 225/19 |
| 2,229,961 A | | 1/1941 | Deane | |
| 2,310,522 A | | 2/1943 | Gorbatenko | |
| 2,333,924 A | | 11/1943 | Gorbatenko | |
| 2,447,519 A | * | 8/1948 | Marinsky | 225/53 |
| 2,613,879 A | | 10/1952 | Carr, Jr. | |
| 3,034,691 A | * | 5/1962 | Gershen | 225/25 |
| 3,102,671 A | | 9/1963 | Gershen | |
| 3,109,570 A | * | 11/1963 | Maddalena | 225/66 |
| 3,156,603 A | * | 11/1964 | Robinson | 225/45 |
| 3,159,322 A | * | 12/1964 | Martin | 225/56 |
| 3,173,590 A | * | 3/1965 | Bahnsen | 225/33 |
| 3,186,892 A | * | 6/1965 | Walthers | 225/89 |
| 3,266,689 A | | 8/1966 | Hruby | |
| 3,349,979 A | * | 10/1967 | Costello | 225/44 |
| 3,410,465 A | * | 11/1968 | Costello | 225/65 |

(List continued on next page.)

FOREIGN PATENT DOCUMENTS

| | | |
|---|---|---|
| DE | 1 002 682 | 2/1957 |
| EP | 1 028 078 A2 | 8/2000 |
| GB | 2 255 925 A | 11/1992 |
| WO | WO 99/49804 | 10/1999 |

OTHER PUBLICATIONS

U.S. patent application Ser. No. 09/571,590, filed May 16, 2000, Docket No. 55591USA8A, "Rolled Sheet Material Dispenser With Protected Sheet Cutting Means".

*Primary Examiner*—Allan N. Shoap
*Assistant Examiner*—Jason Prone
(74) *Attorney, Agent, or Firm*—William L. Huebsch

(57) ABSTRACT

A portable dispenser with which lengths of a sheet material may be manually dispensed from a supply roll of the sheet material. The dispenser has a frame including a bridging portion adapted to extend along a portion of the periphery of the roll of sheet material, and end wall portions fixed to the ends of the bridging portion and adapted to extend along the opposite end surfaces of the roll of sheet material on which the roll of sheet material is rotatably journaled. A resiliently flexible cantilevered portion of the frame has a proximal edge fixed to the bridging portion and has a sharp cutting edge along its opposite distal edge. A guard portion of the frame extends between its end wall portions and has an inner surface extending along the side of the cutting edge opposite the roll. The cantilevered portion is normally positioned in a retracted position at which the cutting edge is spaced from the roll of sheet material and is positioned adjacent the inner surface of the guard portion to restrict contact with the cutting edge by a person handling the dispenser such as to withdraw a length of sheet material from the dispenser. The cantilevered portion can be manually flexed by a person grasping the outer surface of the frame to move the cutting edge away from the inner surface of the guard portion to a cutting position at which sheet material being pulled from the roll can be engaged with the cutting edge to transversely sever the sheet material.

9 Claims, 4 Drawing Sheets

U.S. PATENT DOCUMENTS 3,468,743 A * 9/1969 Soriano ..... 225/7
3,696,980 A * 10/1972 Waltz ..... 225/66
3,709,445 A * 1/1973 Adams ..... 242/596.2
3,725,182 A * 4/1973 Regan ..... 225/19
3,745,086 A * 7/1973 Parker ..... 225/16
3,843,034 A 10/1974 Lewandowsky
3,970,230 A * 7/1976 Horn ..... 225/56
4,194,658 A * 3/1980 Tschudin ..... 225/65
4,579,267 A 4/1986 Planke
4,781,316 A * 11/1988 Freeberg ..... 225/71
4,989,769 A 2/1991 Longworth et al.
5,024,362 A * 6/1991 Karlsson ..... 225/20
5,054,675 A * 10/1991 Taves ..... 225/19
5,213,245 A * 5/1993 Puaatuua ..... 225/19
5,222,644 A * 6/1993 Moreno ..... 225/19
5,383,590 A 1/1995 Ho
5,660,313 A * 8/1997 Newbold ..... 225/42
6,039,102 A 3/2000 Sadrakula et al.

* cited by examiner

ROLLED SHEET MATERIAL DISPENSER WITH SAFER SHEET CUTTING MEANS

FIELD OF THE INVENTION

The present invention relates to dispensers with which lengths of sheet material may be manually dispensed from rolled supplies of the sheet materials carried on the dispensers, which dispensers include cutting members having sharp cutting edges adapted for transversely cutting dispensed lengths of the sheet materials from the rolls of sheet materials remaining on the dispensers, and further include means for protecting users of the dispensers from the cutting members between their uses to cut the sheet materials.

DESCRIPTION OF THE RELATED ART

The art is replete with dispensers with which lengths of sheet materials may be manually dispensed from supplies of the sheet materials (typically in rolls) that are carried on the dispensers, which dispensers include cutting members having cutting edges adapted for transversely cutting dispensed lengths of the sheet materials from the supplies of sheet materials remaining on the dispensers, and which dispensers further include means for protecting users of the dispensers from the cutting members between their uses to cut the sheet materials. U.S. Pat. Nos. 2,229,961; 4,989,769 describing a guard for a cutting blade adapted to cut folded polymeric sheet material described in U.S. Pat. No. 4,913,767; U.S. patent application Ser. No. 08/855,687 filed May 14, 1997, (International Publication Number WO 98/51603); U.S. patent application Ser. No. 09/052,400 filed Mar. 31, 1998, (International Publication Number WO 99/49804); and U.S. patent application Ser. No. 09/571,590 filed May 16, 2000, provide illustrative examples.

SUMMARY OF THE INVENTION

The present invention provides a portable dispenser with which lengths of a sheet material may be manually dispensed from a supply roll of the sheet material carried on the dispenser, which dispenser includes means for providing a cutting edge adapted for transversely cutting a dispensed length of the sheet material from the supply of sheet material remaining on the dispensers, and which dispenser further includes means for protecting users of the dispenser from the cutting edge between their uses to cut the sheet material which is either less expensive, more effective for the intended use, or simpler to use than such means that have been provided on known prior art dispensers.

The portable dispenser according to the present invention comprises a frame including a bridging portion adapted to extend along a portion of the periphery of the roll of sheet material to position opposite ends of the bridging portion at end surfaces of the roll, and end wall portions fixed to the ends of the bridging portion and adapted to extend along the opposite end surfaces of the roll of sheet material; and means on the end wall portions adapted for journaling the roll of sheet material for rotation about its axis with the end surfaces of the roll adjacent the end wall portions of the frame and the bridging portion of the frame extending along the periphery of the roll. The frame further includes a resiliently flexible cantilevered portion having a proximal edge fixed to the bridging portion. Means for providing a sharp cutting edge are positioned along an opposite distal edge of the cantilevered portion. A guard portion of the frame extends between its end wall portions and has a inner surface extending along the side of the cutting edge opposite the roll. That cantilevered portion is normally positioned in a retracted position at which the cutting edge is spaced from the roll of sheet material and is positioned adjacent the inner surface of the guard portion to restrict contact with the cutting edge by a person handling the dispenser such as to withdraw a length of sheet material from the dispenser. The cantilevered portion can be manually flexed by a person grasping the outer surface of the frame to move the cutting edge away from the inner surface of the guard portion to a cutting position at which sheet material being pulled from the roll can be engaged with the cutting edge to transversely sever the sheet material.

In its retracted position the cantilevered portion can be slightly flexed to bias the cutting edge against the inner surface of the guard portion.

The means for providing a sharp cutting edge along the distal edge of the cantilevered portion can comprise a metal cutting blade attached to the cantilevered portion along its distal edge, in which case the cantilevered portion can be slightly flexed in the retraced position to bias that metal cutting blade against the inner surface of the guard portion. In this case, the distal edge of the cantilevered portion of the frame can be spaced from the inner surface of the guard portion (which facilitates molding the frame as a single unit), and the metal cutting blade extends from the distal edge of the cantilevered portion to and along the inner surface of the guard portion.

BRIEF DESCRIPTION OF THE DRAWINGS

The present invention will be further described with reference to the accompanying drawing wherein like reference numerals refer to like parts in the several views, and wherein:

FIGS. 3 and 4 are end views of the dispenser of FIG. 1 in which FIG. 3 illustrates the sheet material severing means in a normal retracted position, and FIG. 4 illustrates the sheet material severing means in a cutting position at which it may be manually positioned so that the sheet material can be cut;

FIGS. 6 and 7 are cross sectional views of a second embodiment of a dispenser including protected sheet material severing means according to the present invention in which a roll of sheet material to be dispensed is journaled, in which FIG. 6 illustrates the sheet material severing means in a normal retracted position, and FIG. 7 illustrates the sheet material severing means in a cutting position at which it may be manually positioned so that the sheet material can be cut.

DETAILED DESCRIPTION

Figure 1:
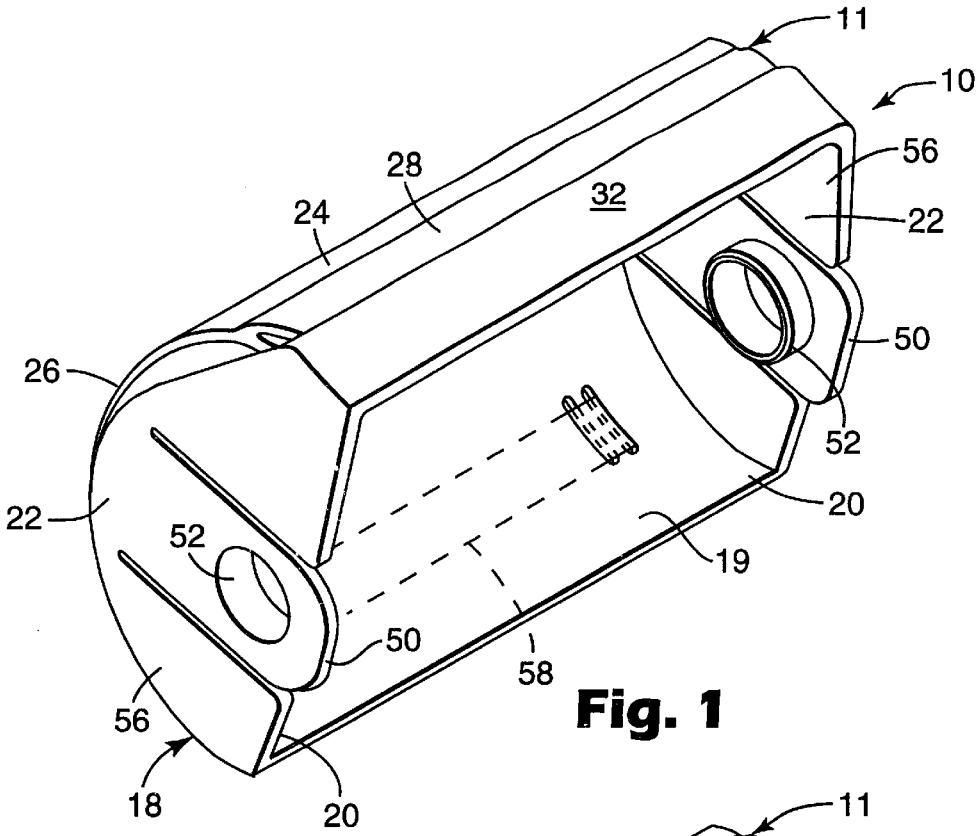
FIG. 1 is a perspective view of a first embodiment of a dispenser including protected sheet material severing means according to the present invention.
Figure 2:
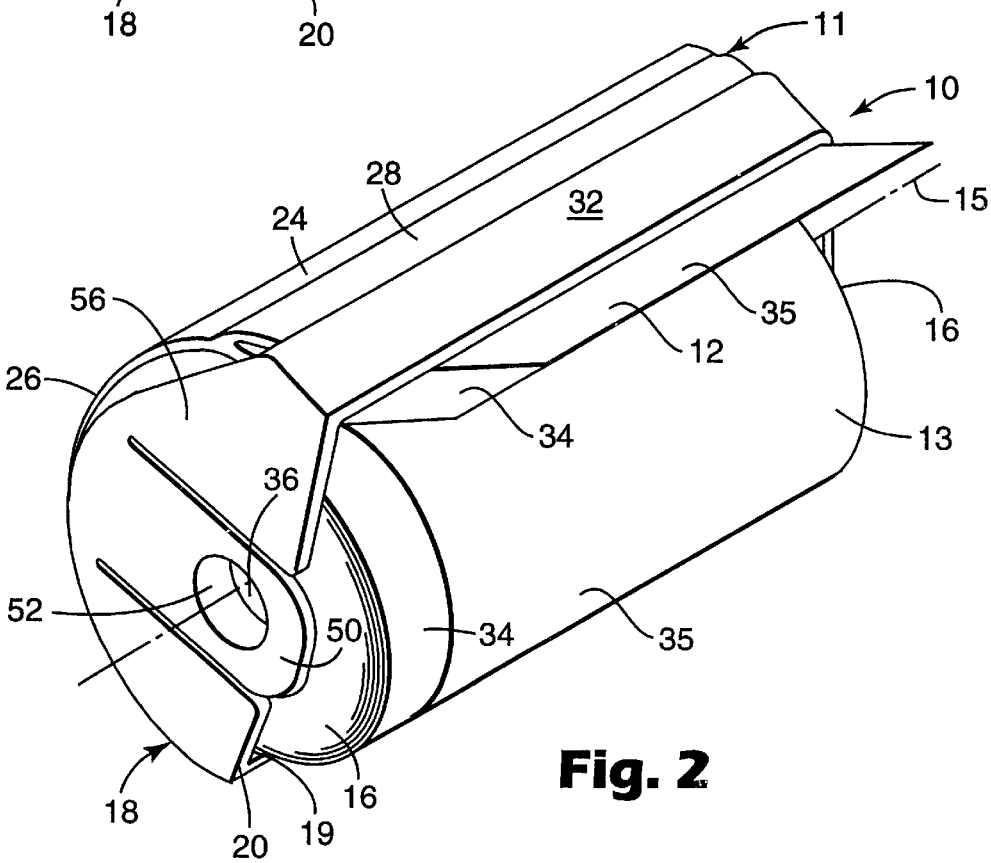
FIG. 2 is a perspective view of the dispenser of FIG. 1 in which a roll of sheet material to be dispensed is journaled.
Figure 3:
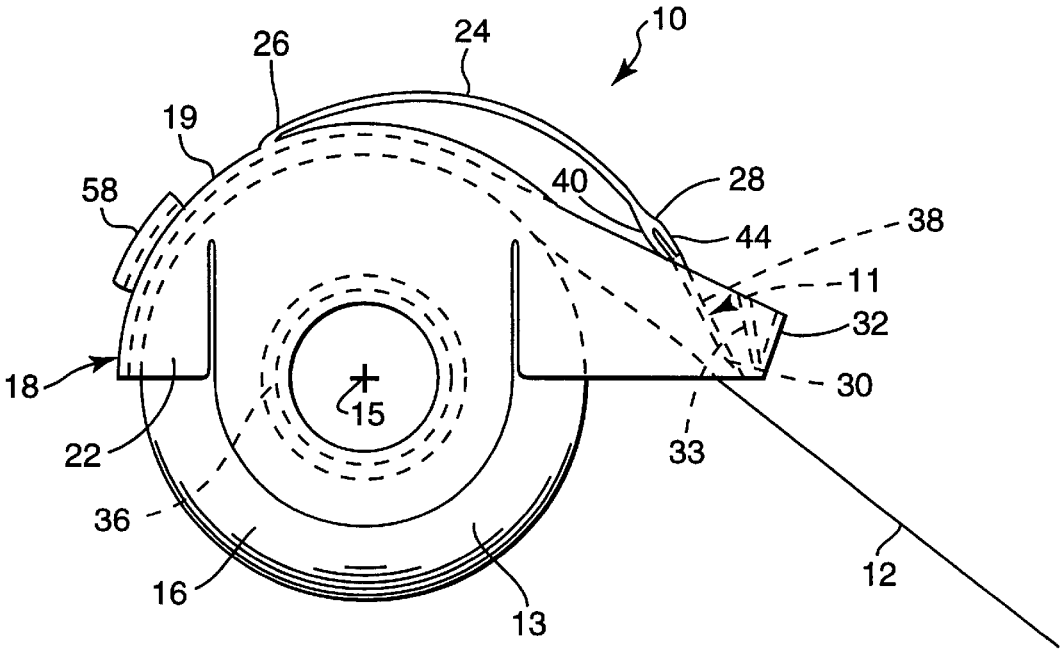
Figure 4:
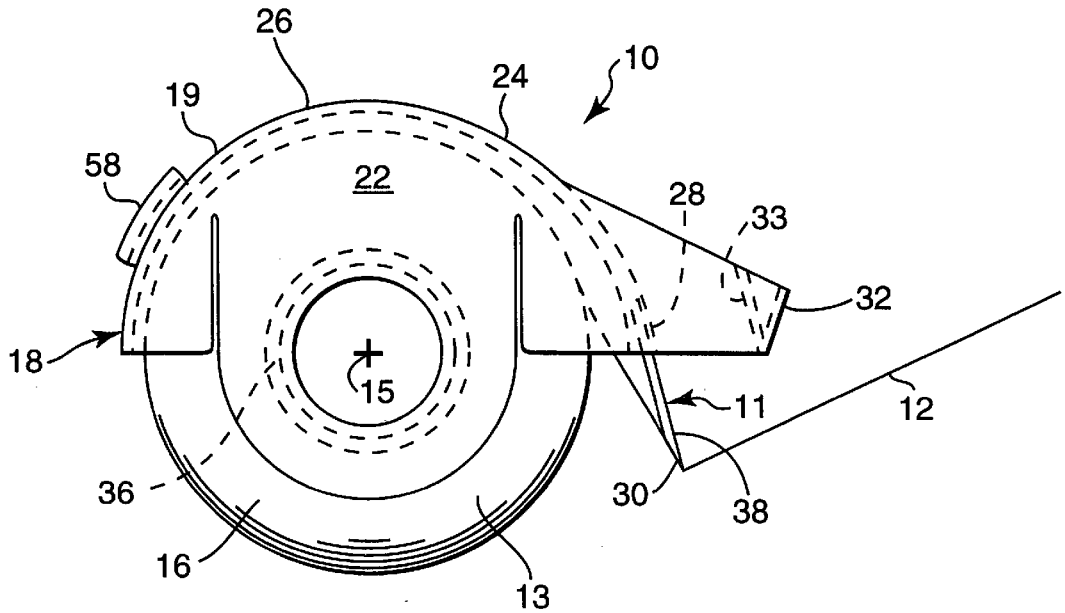

Referring now to FIGS. 1 through 5 of the drawing, there is shown a first embodiment of a dispenser 10 including protected sheet severing means 11 according to the present invention.

The dispenser 10 is portable and of the type from which sheet material 12 may be manually dispensed or pulled from a roll 13 of the sheet material 12 (see FIGS. 2, 3, and 4) having a generally cylindrical periphery about an axis 15 and having axially spaced end surfaces 16. The dispenser 10 comprises a frame 18 of polymeric material (e.g., ABS or Hi Impact Polystyrene) including a bridging portion 19 having opposite ends 20, which bridging portion 19 is arcuate or semi-cylindrical and is thereby adapted to extend along a portion of the periphery of the roll 13 with its ends 20 positioned at the end surfaces 16 of the roll. The frame 18 further includes two end wall portions 22 fixed to the ends 20 of the bridging portion 19 and adapted to extend at generally a right angle thereto along the opposite end surfaces 16 of the roll 13 of sheet material 12. Means (later to be explained) on those end wall portions 22 are adapted for journaling the roll 13 of sheet material 12 for rotation about its axis 15 with the end surfaces 16 of the roll 13 adjacent the end wall portions 22 and the bridging portion 19 extending along the periphery of the roll 13.

The frame 18 further includes a resiliently flexible cantilevered portion 24 having a proximal edge 26 generally parallel to the axis 15 and extending from or fixed to the bridging portion 19, and having an opposite distal edge 28 also parallel to the axis 15. The cantilevered portion 24, like the bridging portion 19, is also arcuate or semi cylindrical, but unlike the bridging portion 19, is not attached to the end wall portions 22. The dispenser 10 includes means for providing a sharp cutting edge 30 along the distal edge 28 of the cantilevered portion 24, which cutting edge 30 is adapted for transversely cutting the sheet material 12. The frame 18 also further includes a guard portion 32 extending between its end wall portions 22, which guard portion 32 has a inner surface 33 extending along the side of the cutting edge 30 opposite the roll 13. The cantilevered portion 24 is normally positioned in a retracted position (see FIGS. 1, 2, and 3) at which the cutting edge 30 is spaced from the roll 13 journaled between the end wall portions 22 and is positioned adjacent the inner surface 33 of the guard portion 32 to restrict contact between a person using the dispenser 10 and the cutting edge 30. The cantilevered portion 24 can be manually flexed (e.g., by a person grasping the cylindrically convex outer surfaces of the bridging and cantilevered portions 19 and 24 of the frame 18) to move the cutting edge 30 away from the inner surface 33 of the guard portion 32 to a cutting position (see FIG. 4) at which sheet material 12 being pulled from the roll 13 can be engaged with the cutting edge 30 to transversely sever the sheet material 12.

The sheet material 12 in the roll 13 can be any flexible cuttable sheet material, or a composite of two or more such sheet materials. Such sheet material or materials include, but are not limited to, paper, thin metal, cloth, polymeric material (e.g., film, woven or non-woven fibers) or combinations thereof, which sheet material or materials may or may not be coated with a material such as pressure sensitive adhesive (i.e., adhesive tape) or an abrasive (i.e., sandpaper), or both. The dispenser 10 is particularly adapted for use with sheet material 12 that, as illustrated, is a composite of adhesive coated tape 34 and transversely folded polymeric film 35, which film 35 is similar to that commercially available from 3M Company, St. Paul, Minn., under the trade designation "READYMASK" (™) pre-taped film. Also, the dispenser 10 should work well to dispense adhesive coated tapes with heavy backings such as duct tapes or masking tapes. The sheet material 12 can, as illustrated, be wound on a hollow cylindrical core 36 which can project a short distance (e.g., about 0.1 inch or 0.25 cm) from both of the end surfaces 16 of the roll 13 of sheet material 12 to help insure that the entire width of the sheet material 12 will be engaged by the cutting edge 30.

In the dispenser 10, the distal edge 28 of the cantilevered portion 24 of the frame 18 is spaced from the guard portion 32. The means for providing the sharp cutting edge 30 along the distal edge 28 of the cantilevered portion 24 comprises a metal cutting blade 38 attached along the distal edge 28 of the cantilevered portion 24, which metal cutting blade 38 extends from the distal edge 28 of the cantilevered portion 24 to and along the inner surface 33 of the guard portion 32. This structure provides several advantages, including the ability to mold the frame 18 including its bridging portion 19, its end wall portions 22, its cantilevered portion 24, and its guard portion 32 as a single unitary molding. Also, the cantilevered portion 24 of the frame 18 can be molded so that in its retracted position it will be slightly flexed to bias the metal cutting blade 38 against the inner surface 33 of the guard portion 32 (i.e., during assembly of the metal cutting blade 38 on the cantilevered portion 24 the cantilevered portion 24 must be flexed, after which engagement of the cutting blade 38 along the inner surface 33 of the guard portion 32 will retain a slight flexure in the cantilevered portion 24).

Figure 5:
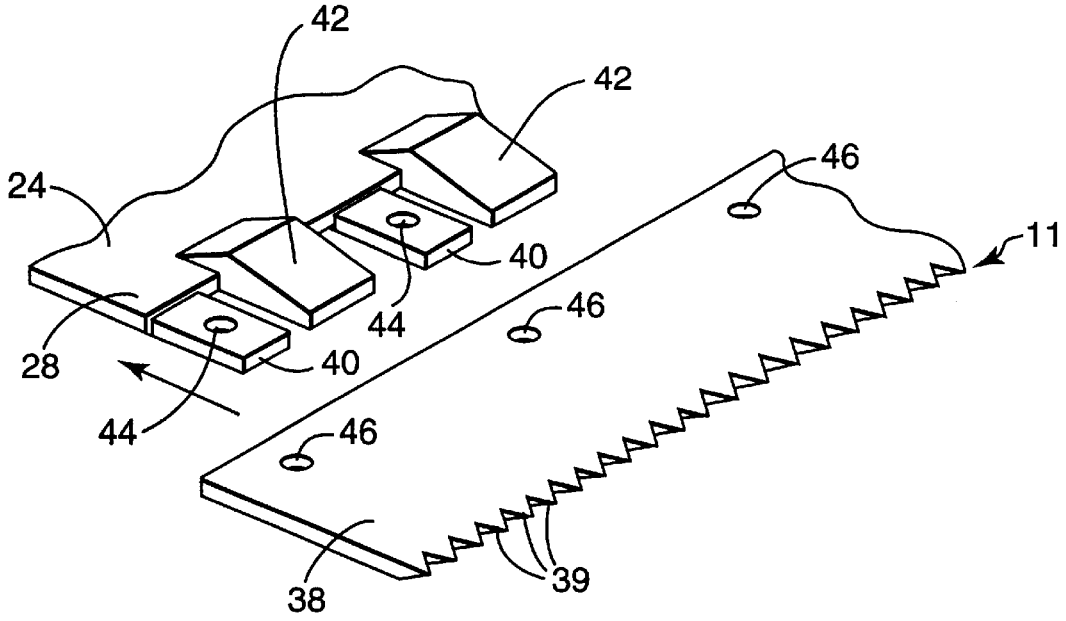
FIG. 5 is a perspective enlarged fragmentary view of the engagement between a cutting blade and a cantilevered portion of the dispenser.

The cutting edge 30 on the blade 38 is provided along a plurality of similarly shaped triangular teeth 39, which teeth 39 have bases aligned in a first direction longitudinally along the blade 38 parallel with the distal edge 28 of the cantilevered portion 24 with the points of the teeth 39 projecting in the same direction at right angles to that distal edge 28. Those teeth 39, which are similar to the teeth described in U.S. Pat. No. 4,913,767 (the content whereof is incorporated herein by reference), can pierce the sheet material 12 when the cantilevered portion 24 is manually flexed to move the cutting edge 30 to its cutting position, so that further tension applied on the sheet material 12 will cause the teeth 39 to further penetrate the sheet material 12 as a result of tension being applied to withdraw the composite sheet material 12 until the sheet material 12 is severed by the cutting edge 30. The blade 38 can be attached along the distal edge 28 of the cantilevered portion 24 as is illustrated in FIG. 5 by providing a series of spaced alternating tabs 40 and 42 projecting along that distal edge 28 from opposite surfaces of the cantilevered portion 24. The tabs 40 have projections 44 with top cam surfaces increasing in height toward that distal edge 28. The blade 38 has spaced openings 46 adapted to receive the projections 44 when the edge of the blade 38 opposite its cutting edge 30 is slid between the tabs 40 and 42 toward that distal edge 28 so that the cam surfaces on the projections 44 deflect the tabs 40 until the projections 44 enter the openings 46. Thereafter, the projections 44 maintain the blade 38 between the tabs 40 and 42.

As an example, when the frame 18 including the cantilevered portion 24 is of ABS, the cantilevered portion is semi-cylindrical about a 1.5 inch (3.8 cm) radius, is 0.08 inch (0.2 cm) thick, is 3 inch (7.6 cm) wide between its proximal and distal edges 26 and 28, and is 8 inch (20.3 cm) long, a force easily applied by the thumb of one hand of about one half pound will move it to a cutting position spaced from the inner surface 33 of the guard portion 32 by about 0.5 inch (1.3 cm).

The means on the end wall portions 22 adapted for journaling the roll 13 of sheet material for rotation about its axis with the end surfaces 16 of the roll 13 adjacent the end wall portions 22 and with the bridging portion 19 extending along the periphery of the roll 13 comprises flexible elongate parts 50 of the end wall portions 22 having opposed and axially aligned cylindrical collars 52 projecting toward each other along inner surfaces of the end wall portions 22. The cylindrical peripheries of the collars 52 are adapted to be received within and to journal the cylindrical inner surface of the hollow cylindrical core 36 about which the sheet material 12 is wound. Each of the elongate parts 50 is attached to a primary part 56 of one of the end wall portions 22 only along one end. Each primary part 56 of each end wall portion 22 is quite rigid as it bridges across one end of the arcuate bridging portion 19, however, each of the elongate parts 50 is sufficiently flexible to allow them to be manually spread sufficiently to position the ends of the core 36 between the collars 52, while being sufficiently stiff to retain the collars 52 in the ends of core 36 to journal it when forces applied to spread the elongate parts 50 are released. As an example, an elongate part 50 of ABS, 0.1 inch (2.5 cm) thick, 1.5 inch (3.8 cm) wide, and 1 inch (2.5 cm) long from the center of the collar 52 to its line of attachment to the primary part 56 will perform these functions.

As illustrated, a strap 58 extending generally parallel to the axis of the roll 13 along the outer surface of the bridging portion 19 of the frame 18 has its ends attached through slots in the bridging portion 19 and has a central portion spaced from that bridging portion 19 so that a user of the dispenser 10 can insert his hand between the strap 58 and the bridging portion 19 with his thumb extending over the cantilevered portion 24 to hold and operate the dispenser 10.

Use of the Dispenser 10

To use the dispenser 10 (assuming the roll 13 of sheet material 12 is journaled on the cylindrical collars 52 projecting toward each from the end wall portions 22), a user could simply hold the dispenser 10 along its outer surface with one hand inserted between the strap 58 and the bridging portion 19 with the users thumb extending over the cantilevered portion 24, and pull the sheet material 12 from the roll 13 with his or her other hand. This is done without significant pressure on the cantilevered portion 24 by the users hand so that the cantilevered portion 24 remains in its normal retracted position (FIGS. 1, 2, and 3) at which the cutting edge 30 is spaced from the roll 13 and is positioned adjacent the inner surface 33 of the guard portion 32 to restrict contact between the user and the cutting edge 30 and between the sheet material 12 being dispensed and the cutting edge 30.

When the user has pulled a desired length of the sheet material 12 from the roll 13, the user then presses on the flexible cantilevered portion 24 with his or her thumb to move the cutting edge 30 away from the inner surface 33 of the guard portion 32 to its cutting position (FIG. 4) at which the sheet material 12 being pulled from the roll 13 is engaged with the cutting edge 30 to transversely sever the sheet material 12. This is done by causing the teeth 39 defining the cutting to pierce the sheet material 12, and then pulling on the dispensed length of sheet material 12 until the teeth 39 cut through the sheet material 12.

When all of the sheet material 12 is dispensed, the empty core 36 about which it had been wound can be separated from the dispenser 10 and a new roll 13 of sheet material 12 mounted about the collars 52 by manually flexing one or both of the elongate flexible parts 50 of the end wall portions 22 away from the other, removing the empty core 36, inserting the new roll 13, and then releasing the flexible parts 50 so that the collars enter and journal the core 36 of the new roll 13 of sheet material.

Second Embodiment

Figure 6:
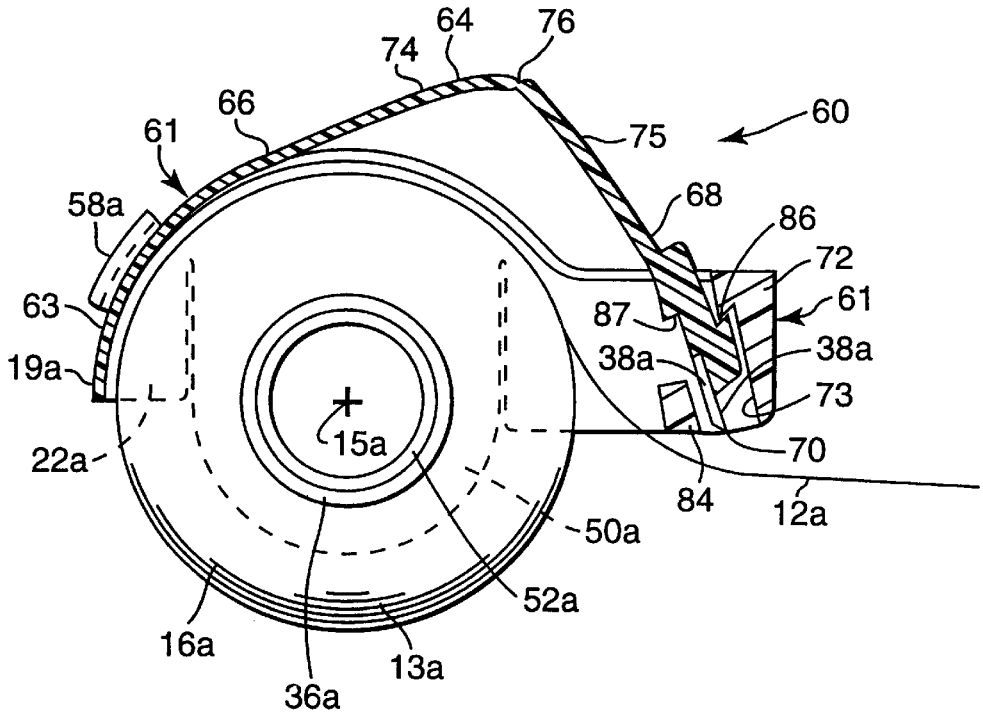
Figure 7:
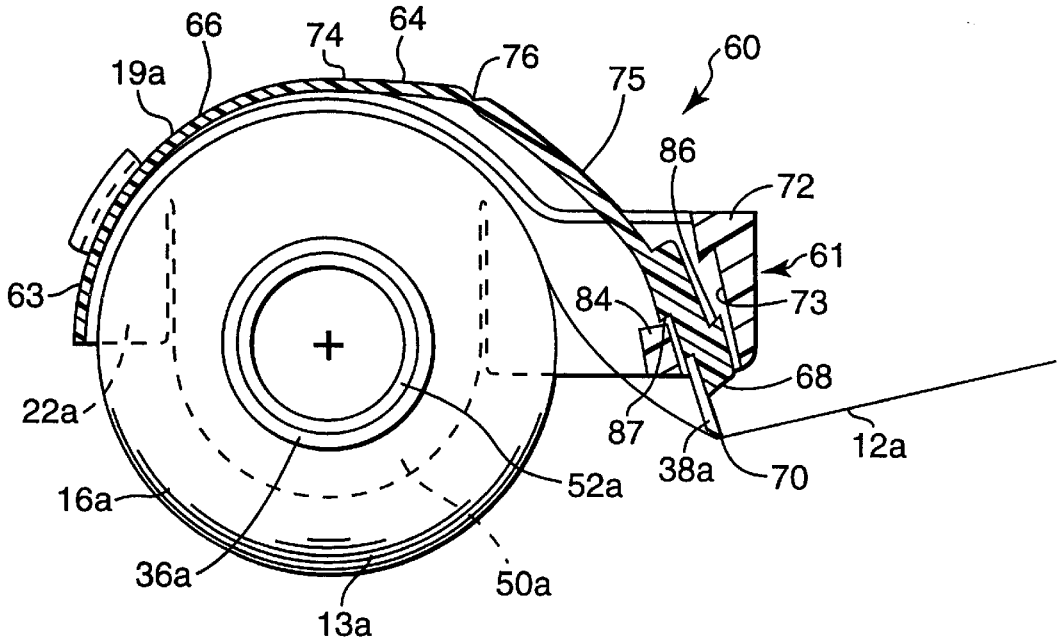

Referring now to FIGS. 6 and 7 of the drawing, there is shown a second embodiment of a dispenser 60 including protected sheet severing means 61 according to the present invention. The dispenser 60 has parts that are essentially the same as the parts of the dispenser 10 identified with the same reference numerals to which have been added the suffix "a".

The dispenser 60 is portable and of the type from which sheet material 12*a* may be manually dispensed or pulled from a roll 13*a* of the sheet material 12*a* about a core 36*a*, and comprises a frame 63 of polymeric material including an arcuate or semi-cylindrical bridging portion 19*a*. The frame 63 also includes two end wall portions 22*a* fixed to the ends of the bridging portion 19*a* and adapted to extend at generally a right angle thereto along the opposite end surfaces 16*a* of the roll 13*a* of sheet material 12*a* so that cylindrical collars 52*a* on the flexible elongate parts 50*a* of the end wall portions 22*a* will journal the roll 13*a* of sheet material 12*a* for rotation about its axis 15*a*.

The frame 63 further includes a resiliently flexible cantilevered portion 64 having a proximal edge 66 generally parallel to the axis 15*a* and extending from or fixed to the bridging portion 19*a*, and having an opposite distal edge 68 also parallel to the axis 15*a*. The cantilevered portion 64, unlike the bridging portion 19*a*, is not attached to the end wall portions 22*a*. Means are provided for providing a sharp cutting edge 70 along the distal edge 68 of the cantilevered portion 64 (e.g., using a metal blade 38*a* having the same structure and attached like the blade 38 described above), which cutting edge 70 is adapted for transversely cutting the sheet material 12*a*. The frame 63 also further includes a guard portion 72 extending between and fixed at its ends to the end wall portions 22*a*, which guard portion 72 has a inner surface 73 extending along the side of the cutting edge 70 opposite the roll 13*a*. The cantilevered portion 64 is normally positioned in a retracted position (see FIG. 6) at which the cutting edge 70 is spaced from the roll 13*a* journaled between the end wall portions 22*a* and is positioned adjacent the inner surface 73 of the guard portion 72 to restrict contact between a person using the dispenser 60 and the cutting edge 70. The cantilevered portion 64 can be manually flexed (e.g., by a person grasping the outer surfaces of the bridging and cantilevered portions 19*a* and 64 of the frame 18*a*) to move the cutting edge 70 away from the inner surface 73 of the guard portion 72 to a cutting position (see FIG. 7) at which sheet material 12*a* being pulled from the roll 13*a* can be engaged with the cutting edge 70 to transversely sever the sheet material 12*a*. The cantilevered portion 64 differs from the cantilevered portion 24 described above in that it includes two parts 74 and 75 joined by a thin section 76 of polymeric material to provide what is sometimes called a "living hinge" so that when the cantilevered portion 64 is manually flexed by a person to move the cutting edge 70 away from the inner surface 73 of the guard portion 72 to its cutting position, the cantilevered portion 64 will bend along the thin section 76 to afford such movement. Also, the dispenser 60 further includes a guide member 84 that extends between the end wall portions 22*a* on the side of the guard portion 72 adjacent the roll 13*a*. The guide member 84, together with the guard portion 72, guides the movement of the distal end 68 of the cantilevered portion 64 as it is moved from its retracted portion to its cutting position. As illustrated, the distal end 68 of the cantilevered portion 64 has lips 86 and 87 with surfaces facing in opposite directions, the lip 86 being positioned to engage a lip along the inner surface 73 of the guard portion 72 to define the retracted position of the cantilevered portion 64 (see FIG. 6), and the lip 87 being positioned to engage a lip on the guide member 84 to define the cutting position of the cantilevered portion 64 (see FIG. 7).

The present invention has now been described with reference to two embodiments 10 and 60. It will be apparent to those skilled in the art that many changes can be made in either of the embodiments 10 or 60 described above without departing from the scope of the present invention. For example, the cutting edge 30 or 70 can be formed on spaced teeth as described above, or alternatively could be any other cutting edge, such as a straight sharp cutting edge of the type used on a razor blade. The cutting edge 30 or 70 can be formed on a metal blade as described above, or, for easily cut materials, could be formed or molded along the distal edge 28 or 68 of the cantilevered portion 24 or 64. Also, in the first embodiment 10 the cantilevered portion 24 can be flexed sufficiently toward the roll 13 of sheet material 12 to engage the periphery of the roll 13, particularly on a roll 13 from which little sheet material 12 has been withdrawn. Such contact can brake rotation of the roll 13 which can facilitate cutting of the dispensed sheet material 12 along the cutting edge 30. Such braking can be enhanced by providing a rough surface and or frictional material along the side of the cantilevered portion 24 adjacent the roll 13. Where such braking is needed for successful cutting of the sheet material 12 the length and flexibility of the cantilevered portion 24 can be adjusted so that the cantilevered portion 24 or side of the blade 38 can be made to contact the sheet material 12 on the core 36 even after almost all of the sheet material 12 has been dispensed from the roll 13. Thus, the scope of the present invention should not be limited to the structures and methods described in this application, but only by the structures and method described by the language of the claims and the equivalents thereof.

What is claimed is:

1. A portable dispenser from which sheet material may be manually dispensed from a roll of the sheet material having a generally cylindrical periphery about an axis and having axially spaced end surfaces, said dispenser comprising:

a frame including a bridging portion having opposite ends, said bridging portion being adapted to extend along a portion of the periphery of the roll to position said ends at the end surfaces of the roll, said frame further including end wall portions fixed to the ends of said bridging portion and adapted to extend along the opposite end surfaces of the roll of sheet material;

means on said end wall portions adapted for journaling the roll of sheet material for rotation about said axis with the end surfaces of said roll adjacent said end wall portions and said bridging portion extending along the periphery of the roll;

a resiliently flexible cantilevered portion having a distal edge and having an opposite proximal edge fixed to said bridging portion and extending generally parallel to said axis; and means for providing a sharp cutting edge along the distal edge of said cantilevered portion adapted for transversely cutting the sheet material;

said frame further including a guard portion extending between said end wall portions, said guard portion having an inner surface extending along the side of said cutting edge opposite the roll and having an edge generally parallel to said axis on the side of said guard portion opposite said proximal edge of said cantilevered portion;

said cantilevered portion normally being positioned in a retracted position at which said cutting edge is positioned along said inner surface of said guard portion to restrict contact between a person using the dispenser and said cutting edge; and manual flexing of said cantilever portion radially inwardly toward said axis causing movement of said cutting edge away from said inner surface, past said edge of said guard portion, and closer to said axis to a cutting position at which sheet material being pulled from the roll can be engaged with said cutting edge to transversely sever the sheet material.

2. A portable dispenser according to claim 1, wherein said bridging portion, said end wall portions, said guard portion, and said cantilevered portion are portions of a single unitary molding of polymeric material.

3. A portable dispenser according to claim 1, wherein in said retracted position said cantilevered portion is slightly flexed to bias said cutting edge against the inner surface of said guard portion.

4. A portable dispenser according to claim 1 wherein said cantilever portion is of polymeric material and said means for providing a sharp cutting edge along the distal edge of said cantilevered portion comprises a metal cutting blade attached to said cantilevered portion along said distal edge.

5. A portable dispenser according to claim 4, wherein each of said end wall portions includes a primary part fixed to a different one of the ends of said bridging portion, and an elongate part having one end fixed to said primary part and an opposite end portion, said means for journaling the roll of sheet material are mounted on said opposite end portions of said end wall portions, and said elongate parts are resiliently flexible to afford spreading of said means for journaling to position the roll of sheet material between said means for journaling.

6. A portable dispenser according to claim 1 further including means along the distal edge of said cantilevered portion for frictionally engaging the periphery of the roll when the cantilevered portion is moved to said cutting position.

7. A portable dispenser from which sheet material may be manually dispensed from a roll of the sheet material having a generally cylindrical periphery about an axis and having axially spaced end surfaces, said dispenser comprising:

a frame including a bridging portion having opposite ends, said bridging portion being adapted to extend along a portion of the periphery of the roll to position said ends at the end surfaces of the roll, said frame further including end wall portions fixed to the ends of said bridging portion and adapted to extend along the opposite end surfaces of the roll of sheet material;

means on said end wall portions adapted for journaling the roll of sheet material for rotation about said axis with the end surfaces of said roll adjacent said end wall portions and said bridging portion extending along the periphery of the roll;

a resiliently flexible cantilevered portion having a distal edge and having an opposite proximal edge fixed to said bridging portion and extending generally parallel to said axis; and means for providing a sharp cutting edge along the distal edge of said cantilevered portion adapted for transversely cutting the sheet material;

said frame further including a guard portion extending between said end wall portions, said guard portion having an inner surface extending along the side of said cutting edge opposite the roll;

said cantilevered portion normally being positioned in a retracted position at which said cutting edge is positioned adjacent said inner surface of said guard portion to restrict contact between a person using the dispenser and said cutting edge;

manual flexing of said cantilever portion affording movement of said cutting edge away from guard portion to a cutting position at which sheet material being pulled from the roll can be engaged with said cutting edge to transversely sever the sheet material;

said cantilevered portion is of polymeric material and comprises a first part having said distal edge and a second part having said proximal edge, said first and second parts being joined by a flexible portion of said cantilevered portion that is thinner than said first and second parts along edges of said parts opposite said distal and proximal edges;

said frame further includes a guide member extending from the end wall portions on the side of the guard portion adjacent the roll, the guide member and the guard portion being positioned to guide the movement of the distal end of the cantilevered portion in generally a first direction as the cantilevered portion is moved from its retracted position to its cutting position; and the distal end of the cantilevered portion has lips with surfaces facing in opposite directions generally normal to said first direction, one of said lips being positioned to engage a surface on the frame to define the retracted position of the cantilevered portion, and the other of said lips being positioned to engage a surface of the frame to define the cutting position of the cantilevered portion.

8. A portable dispenser according to claim 7, wherein said bridging portion, said end wall portions, said guard portion, and said cantilevered portion are portions of a single unitary molding of polymeric material.

9. A portable dispenser according to claim 7, wherein each of said end wall portions includes a primary part fixed to a different one of the ends of said bridging portion, and an elongate part having one end fixed to said primary part and an opposite end portion, said means for journaling the roll of sheet material are mounted on said opposite end portions of said end wall portions, and said elongate parts are resiliently flexible to afford spreading of said means for journaling to position the roll of sheet material between said means for journaling.

* * * * *